US006964120B2

(12) United States Patent
Cartier et al.

(10) Patent No.: US 6,964,120 B2
(45) Date of Patent: Nov. 15, 2005

(54) FOOTWEAR MIDSOLE WITH COMPRESSIBLE ELEMENT IN LATERAL HEEL AREA

(75) Inventors: Mark Cartier, Portland, OR (US); Sergio G. Lozano, Beaverton, OR (US); Tony A. Bignell, Portland, OR (US); Gordon A. Valiant, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 498 days.

(21) Appl. No.: 10/053,495

(22) Filed: Nov. 2, 2001

(65) Prior Publication Data

US 2004/0221483 A1 Nov. 11, 2004

(51) Int. Cl.[7] ..... A43B 13/20; A43B 21/28
(52) U.S. Cl. ..... 36/29; 36/28; 36/35 B
(58) Field of Search ..... 36/102, 27, 28, 36/30 R, 31, 37, 35 R

(56) References Cited

U.S. PATENT DOCUMENTS

| | | | |
|---|---|---|---|
| 507,490 | A | 10/1893 | Gambino |
| 607,086 | A | 7/1898 | Safford |
| 622,673 | A | 4/1899 | Ferrata |
| 933,422 | A | 9/1909 | Dee |
| 949,754 | A | 2/1910 | Busky |
| 1,094,211 | A | 4/1914 | Jenoi et al. |
| 1,099,180 | A | 6/1914 | Karacsonyi |
| 1,102,343 | A | 7/1914 | Kovacs |
| 1,272,490 | A | 7/1918 | Matear |
| 1,278,320 | A | 9/1918 | Ellithorpe |
| 1,338,817 | A | 5/1920 | DeLuca |
| 1,502,087 | A | 7/1924 | Bunns |
| 1,670,747 | A | 5/1928 | Sestito |
| 1,870,065 | A | 8/1932 | Nusser |
| 1,870,114 | A | 8/1932 | Heller |
| 2,104,924 | A | 1/1938 | Dellea |
| 2,122,108 | A | 6/1938 | Modlin |
| 2,198,228 | A | 4/1940 | Pinaud et al. |
| 2,299,009 | A | 10/1942 | Denk |
| 2,437,227 | A | 3/1948 | Hall |
| 2,710,460 | A | 6/1955 | Stasinos |
| 2,721,400 | A | 10/1955 | Israel |
| 3,041,746 | A | 7/1962 | Rakus |
| 3,429,545 | A | 2/1969 | Michel |
| 3,822,490 | A | 7/1974 | Murawski |
| 4,000,566 | A | 1/1977 | Farnolare, Jr. |
| 4,030,213 | A | 6/1977 | Daswick |
| 4,074,446 | A | 2/1978 | Eisenberg |
| 4,183,156 | A | 1/1980 | Rudy |

(Continued)

FOREIGN PATENT DOCUMENTS

| | | |
|---|---|---|
| CH | 570 130 | 9/1974 |
| DE | 806647 | 2/1949 |

(Continued)

OTHER PUBLICATIONS

US 4,974,345, 12/1990, Yung-Mao (withdrawn)
Article entitled "Hoop Dreams" (Applicants do not know the date of publication; however, they believe that the publication date for this reference is at least one year prior to the Nov. 2, 2001 filing date for the present application.) .

(Continued)

*Primary Examiner*—Anthony Stashick
(74) *Attorney, Agent, or Firm*—Banner & Witcoff, Ltd.

(57) ABSTRACT

An article of footwear having a sole structure that includes one or more support elements formed of a resilient, compressible material is disclosed. The lower surface of a support element located in the back-lateral corner of the sole structure includes a downward bevel in the lateral-to-medial direction and back-to-front direction. In addition to the downward bevel on the lower surface of the support element, a base plate and outsole include corresponding bevels. Cooperatively, the bevels reduce the rate of pronation in a foot of a wearer.

23 Claims, 7 Drawing Sheets

U.S. PATENT DOCUMENTS

| | | | | | |
|---|---|---|---|---|---|
| 4,219,945 | A | | 9/1980 | Rudy | |
| 4,223,457 | A | | 9/1980 | Borgeas | |
| 4,237,625 | A | | 12/1980 | Cole et al. | |
| 4,241,523 | A | | 12/1980 | Daswick | |
| 4,255,877 | A | | 3/1981 | Bowerman | |
| 4,262,433 | A | | 4/1981 | Hagg et al. | |
| 4,267,648 | A | | 5/1981 | Weisz | |
| 4,271,606 | A | | 6/1981 | Rudy | |
| 4,271,607 | A | | 6/1981 | Funck | |
| 4,279,797 | A | | 7/1981 | Nelson et al. | |
| 4,287,675 | A | | 9/1981 | Norton et al. | |
| 4,288,929 | A | | 9/1981 | Norton et al. | |
| 4,297,797 | A | | 11/1981 | Meyers | |
| 4,305,212 | A | | 12/1981 | Coomer | |
| 4,314,413 | A | | 2/1982 | Dassler | |
| 4,319,412 | A | | 3/1982 | Muller et al. | |
| 4,342,158 | A | | 8/1982 | McMahon et al. | |
| 4,354,318 | A | | 10/1982 | Frederick et al. | |
| 4,364,188 | A | | 12/1982 | Turner et al. | |
| 4,364,189 | A | | 12/1982 | Bates | |
| 4,399,621 | A | | 8/1983 | Dassler | |
| 4,439,936 | A | | 4/1984 | Clarke et al. | |
| 4,445,283 | A | | 5/1984 | Meyers | |
| 4,492,046 | A | | 1/1985 | Kosova | |
| 4,494,321 | A | | 1/1985 | Lawlor | |
| 4,535,553 | A | | 8/1985 | Derderian | |
| 4,536,974 | A | | 8/1985 | Cohen | |
| 4,546,555 | A | | 10/1985 | Spademan | |
| 4,559,366 | A | | 12/1985 | Hostettler | |
| 4,566,206 | A | | 1/1986 | Weber | |
| 4,592,153 | A | | 6/1986 | Jacinto | |
| 4,594,799 | A | | 6/1986 | Lin | |
| 4,598,484 | A | | 7/1986 | Ma | |
| 4,598,487 | A | | 7/1986 | Misevich | |
| 4,610,099 | A | | 9/1986 | Signori | |
| 4,616,431 | A | | 10/1986 | Dassler | |
| 4,624,062 | A | | 11/1986 | Autry | |
| 4,638,575 | A | | 1/1987 | Illustrato | |
| 4,660,299 | A | | 4/1987 | Omilusik | |
| 4,680,875 | A | | 7/1987 | Danieli | |
| 4,680,876 | A | | 7/1987 | Peng | |
| 4,709,489 | A | | 12/1987 | Welter | |
| 4,715,130 | A | | 12/1987 | Scatena | |
| 4,722,131 | A | * | 2/1988 | Huang | 29/450 |
| 4,731,939 | A | | 3/1988 | Parracho et al. | |
| 4,733,483 | A | | 3/1988 | Lin | |
| 4,746,555 | A | | 5/1988 | Luckanuck | |
| 4,753,021 | A | | 6/1988 | Cohen | |
| 4,774,774 | A | | 10/1988 | Allen, Jr. | |
| D298,583 | S | | 11/1988 | Yung-Mao | |
| 4,794,707 | A | | 1/1989 | Franklin et al. | |
| 4,798,009 | A | | 1/1989 | Colonel et al. | |
| 4,802,289 | A | | 2/1989 | Guldager | |
| 4,815,221 | A | | 3/1989 | Diaz | |
| 4,843,737 | A | | 7/1989 | Vorderer | |
| 4,843,741 | A | | 7/1989 | Yung-Mao | |
| 4,845,863 | A | | 7/1989 | Yung-Mao | |
| 4,878,300 | A | | 11/1989 | Bogaty | |
| 4,881,328 | A | | 11/1989 | Yung-Mao | |
| 4,881,329 | A | | 11/1989 | Crowley | |
| 4,887,367 | A | | 12/1989 | Mackness et al. | |
| 4,905,382 | A | | 3/1990 | Yung-Mao | |
| 4,908,962 | A | | 3/1990 | Yung-Mao | |
| 4,910,884 | A | | 3/1990 | Lindh et al. | |
| 4,918,838 | A | | 4/1990 | Chang | |
| 4,936,029 | A | | 6/1990 | Rudy | |
| 4,956,927 | A | | 9/1990 | Misevich et al. | |
| 4,984,376 | A | | 1/1991 | Walter et al. | |
| 4,989,349 | A | | 2/1991 | Ellis, III | |
| 4,989,350 | A | | 2/1991 | Bunch et al. | |
| D315,634 | S | | 3/1991 | Yung-Mao | |
| 5,014,449 | A | | 5/1991 | Richard et al. | |
| 5,046,267 | A | | 9/1991 | Kilgore et al. | |
| 5,068,981 | A | | 12/1991 | Jung | |
| 5,092,060 | A | | 3/1992 | Frachey et al. | |
| 5,138,776 | A | | 8/1992 | Levin | |
| 5,152,082 | A | | 10/1992 | Culpepper | |
| 5,222,312 | A | | 6/1993 | Doyle | |
| 5,233,767 | A | | 8/1993 | Kramer | |
| 5,247,742 | A | | 9/1993 | Kilgore et al. | |
| 5,317,819 | A | | 6/1994 | Ellis, III | |
| 5,337,492 | A | * | 8/1994 | Anderie et al. | 36/28 |
| 5,343,639 | A | * | 9/1994 | Kilgore et al. | 36/29 |
| 5,353,523 | A | | 10/1994 | Kilgore et al. | |
| 5,425,184 | A | | 6/1995 | Lyden et al. | |
| 5,572,804 | A | | 11/1996 | Skaja et al. | |
| 5,625,964 | A | | 5/1997 | Lyden et al. | |
| 5,685,090 | A | | 11/1997 | Tawney et al. | |
| 5,782,014 | A | | 7/1998 | Peterson | |
| 5,853,844 | A | | 12/1998 | Wen | |
| 5,976,451 | A | | 11/1999 | Skaja et al. | |
| 5,983,529 | A | * | 11/1999 | Serna | 36/28 |
| 6,018,889 | A | | 2/2000 | Friton | |
| 6,055,746 | A | | 5/2000 | Lyden et al. | |
| 6,055,747 | A | | 5/2000 | Lombardino | |
| 6,115,944 | A | | 9/2000 | Lain | |
| 6,131,310 | A | | 10/2000 | Fang | |
| D433,216 | S | | 11/2000 | Avar et al. | |
| 6,233,846 | B1 | | 5/2001 | Sordi | |
| 6,305,100 | B1 | | 10/2001 | Komarnycky et al. | |
| 6,457,261 | B1 | | 10/2002 | Crary | |
| 6,598,320 | B2 | * | 7/2003 | Turner et al. | 36/28 |
| 6,647,645 | B2 | * | 11/2003 | Kita | 36/28 |
| 6,694,642 | B2 | * | 2/2004 | Turner | 36/28 |
| 6,722,058 | B2 | * | 4/2004 | Lucas et al. | 36/28 |

FOREIGN PATENT DOCUMENTS

| | | | | |
|---|---|---|---|---|
| DE | 1485654 | | 1/1965 | |
| DE | 3400997 | | 7/1985 | |
| EP | 510943 | * | 10/1992 | A43B/13/18 |
| ES | 2080933 | | 1/1990 | |
| ES | 1036287 | | 1/1997 | |
| FR | 465267 | | 4/1914 | |
| FR | 1227420 | | 4/1960 | |
| FR | 2556118 | | 6/1985 | |
| GB | 21594 | | 7/1903 | |
| GB | 7163 | | 10/1906 | |
| GB | 2 032 761 | | 5/1980 | |
| GB | 2 173 987 | A | 10/1986 | |
| JP | 146188 | | 11/1990 | |
| SU | 1526637 | A1 | 12/1989 | |
| WO | WO 92/08383 | * | 5/1992 | A43B/13/18 |

OTHER PUBLICATIONS

Advertisement for Aura "Introducing the exciting new performance driven 2001 Aura.".

Web page translation using babelfish, entitled "The tennis shoe with the motivating force" (Applicants do not know the date of publication; however, they believe that the publication date for this reference is at least one year prior to the Nov. 2, 2001 filing date for the present application.) .

Elastocell™ Microcellular Polyurethane Products, Technical Information, Elastocell™, a Means for Antivibration and Sound Isolation (Applicants do not know the date of publication; however, they believe that the publication date for this reference is at least one year prior to the Nov. 2, 2001 filing date for the present application.) .

Elastocell™ Microcellular Polyurethane Products, Material Data Technical Information, Long Term Static and Dynamic Loading of Elastocell® (Applicants do not know the date of publication; however, they believe that the publication date for this reference is at least one year prior to the Nov. 2, 2001 filing date for the present application.) .

Elastocell™ Microcellular Polyurethane Products, Technical Bulletin, Spring and Damping Elements made from Elastocell (Applicants do not know the date of publication; however, they believe that the publication date for this reference is at least one year prior to the Nov. 2, 2001 filing date for the present application.) .

FWN, vol. 40, No. 38, Sep. 17, 1990, "Marco Scatena puts spring in Athlon wearers' control".

SAE Technical Paper Series, "Microcellular Polyurethane Elastomers as Damping Elements in Automotive Suspension Systems," by Christoph Prolingheuer and P. Henrichs, International Congress and Exposition, Detroit, Michigan, Feb. 25–Mar. 1, 1991.

Spring– and Shock Absorber Bearing Spring Elements, Springing Comfort with High Damping (Applicants do not know the date of publication; however, they believe that the publication date for this reference is at least one year prior to the Nov. 2, 2001 filing date for the present application.).

Activ Power Spring System catalog, front and back pages with English translation of back page.

* cited by examiner

FOOTWEAR MIDSOLE WITH COMPRESSIBLE ELEMENT IN LATERAL HEEL AREA

BACKGROUND OF THE INVENTION

1. Field of the Invention

The present invention relates to footwear having a sole with a compressible element in a lateral heel area. More particularly, the present invention is directed toward a sole having a compressible support element designed to limit the rate at which a wearer's foot pronates.

2. Description of Background Art

Sole design for modern athletic footwear is generally characterized by a multi-layer construction comprised of an outsole, midsole, and insole. The midsole, typically a soft, foam material, attenuates impact forces generated by contact of the footwear with the ground during athletic activities. Other prior art midsoles use fluid-filled bladders of the type disclosed in U.S. Pat. Nos. 4,183,156 and 4,219,945 to Marion F. Rudy. Although foam materials succeed in providing cushioning for the foot, foam materials may also impart instability that increases in proportion to midsole thickness. For this reason, design of footwear with conventional foam midsoles involves balancing the relative degrees of cushioning and stability.

The typical motion of the foot during running proceeds as follows: First, the heel strikes the ground, followed by the ball of the foot. As the heel leaves the ground, the foot rolls forward so that the toes make contact, and finally the entire foot leaves the ground to begin another cycle. During the time that the foot is in contact with the ground and rolling forward, it also rolls from the outside or lateral side to the inside or medial side, a process called pronation. That is, normally, the outside of the heel strikes first and the toes on the inside of the foot leave the ground last. While the foot is air borne and preparing for another cycle the opposite process, called supination, occurs. Pronation, the inward roll of the foot while in contact with the ground, although normal, can be a potential source of foot and leg injury, particularly if it is excessive. The use of soft cushioning materials in the midsole of running shoes, while providing protection against impact forces, can encourage instability of the sub-talar joint of the ankle, thereby contributing to the tendency for over-pronation. This instability has been cited as a contributor to "runners knee" and other athletic injuries.

Various methods for resisting excessive pronation or instability of the sub-talar joint have been proposed and incorporated into prior art athletic shoes as "stability" devices. In general, these devices have been fashioned by modifying conventional shoe components, such as the heel counter, by modifying the midsole cushioning materials or adding a pronation control device to a midsole. Examples of these techniques are found in U.S. Pat. Nos. 4,288,929; 4,354,318; 4,255,877; 4,287,675; 4,364,188; 4,364,189; 4,297,797; 4,445,283; and 5,247,742.

One particular method of resisting over pronation, disclosed in U.S. Pat. Nos. 5,425,184; 5,625,964; and 6,055,746, all to Lyden et al. and hereby incorporated by reference, utilizes a strike zone located in the rear, lateral corner of the sole. The strike zone is segmented from the remaining heel area by a line of flexion which permits articulation of the strikezone during initial contact with the ground. The strikezone includes a portion of a fluid-filled bladder structure with a lower pressure than portions in other areas of the sole. Accordingly, the strikezone operates to limit the rate of pronation following heel strike.

U.S. Pat. Nos. 5,353,523 and 5,343,639 to Kilgore et al., hereby incorporated by reference, disclose a prior art athletic shoe wherein a portion of the foam midsole is replaced with foam columns placed between a rigid top and bottom plate. A similar, prior art article of footwear, commercially manufactured and distributed by NIKE, Inc. under the SHOX trademark, is depicted as shoe 10 in FIGS. 1 and 2. Shoe 10 includes a conventional upper 12 attached in a conventional manner to a sole 14. Sole 14 includes a midsole 18 and a conventional outsole layer 20 formed of a wear-resistant material such as a carbon-black rubber compound. Midsole 18 includes a cushioning layer (not shown) made of a conventional cushioning material such as ethyl vinyl acetate or polyurethane foam, a top plate 28, a bottom plate 30, four compliant elastomeric support elements 32 disposed between top plate 28 and bottom plate 30, and a midfoot wedge 40.

Elements 32 have the shape of hollow, cylindrical columns with integral rings circumscribing the exterior surface. Whereas the front two elements 32 have a generally horizontal lower surface, the rear two elements 32 have an upward bevel in a longitudinal direction relative to shoe 10. In combination with a corresponding bevel in outsole layer 20, the rear portion of shoe 10 includes an upward bevel that extends across the rear portion of the footwear.

Elements 32 have a beneficial effect with respect to the control of pronation. As noted, the foot typically contacts the ground in the rear-lateral corner. The foot then rolls forward and rotates from the lateral side to the medial side while in contact with the ground. When the foot initially contacts the ground, the rear-lateral support element bears the majority of the impact force associated with ground contact and deflects accordingly. As the foot rolls forward and to the medial side, the force of impact is transferred to the front-lateral support element and the rear-medial support element. At this point, the front-lateral and the rear-medial support elements are both absorbing the impact forces previously supported by only the rear-lateral support element. Accordingly, the increased resistance to compression slows the rate of rotation to the medial side, thereby countering over pronation. As the foot continues to roll forward, the front-medial support element further limits pronatory motion.

Although the design of the design of shoe 10 has a beneficial effect upon pronation, individuals with a tendency to over pronate may require an article of footwear that controls pronation to a greater degree. The present invention provides such an article of footwear.

BRIEF SUMMARY OF THE INVENTION

The present invention relates to an article of footwear for receiving a foot of a wearer, the footwear including an upper and a sole structure attached to said upper. The sole structure includes a midsole and an outsole, the midsole further including a compressible first support element located above a portion of the outsole in a back-lateral corner of the sole structure A lower surface of the first support element has a downward bevel in a lateral-to-medial and a back-to-front direction that reduces the rate at which the foot pronates.

The first support element is generally configured in the shape of a column, such as a hollow cylinder. In addition to the first support element, the footwear includes second, third, and fourth support elements that are distributed throughout the heel region of the sole structure and have a structure that is similar to that of the first support element. Unlike the first support that includes the downward bevel on the lower surface, the second, third, and fourth support elements generally have a horizontal upper and lower surface. Although a major portion of the support elements may be discrete, they may also be formed integral with a common base.

The primary purpose of the beveled portion, particularly the downward bevel in the first support element is to reduce the rate of pronation in the wearer's foot. When the beveled portion contacts a playing surface, the curvature of the beveled portion permits the footwear to smoothly transition from the position at heel strike, wherein only the back-lateral corner of the footwear is in contact with the ground, to the position where a substantial portion of the outsole is in contact with the ground. That is, the beveled portion permits the footwear to smoothly roll both forward and to the medial side following heel strike. This smooth transition ensures that impact forces are first absorbed by the back-lateral support element and then gradually transferred to other support elements, thereby reducing the rate of pronation.

The various advantages and features of novelty that characterize the present invention are pointed out with particularity in the appended claims. To gain an improved understanding of the advantages and features of novelty that characterize the present invention, however, reference should be made to the descriptive matter and accompanying drawings which describe and illustrate preferred embodiments of the invention.

DETAILED DESCRIPTION OF THE INVENTION

Figure 1:
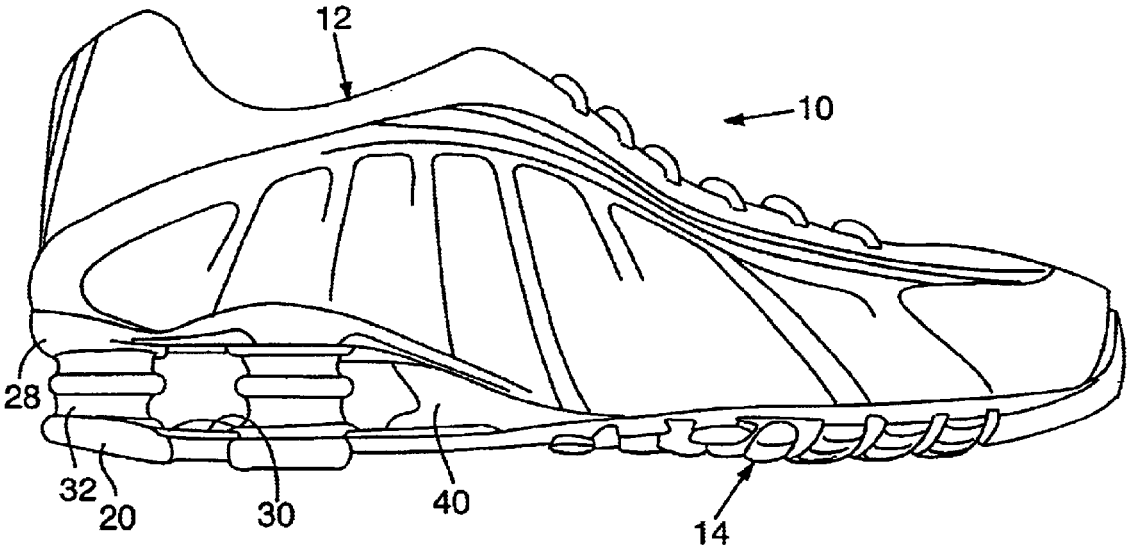
FIG. 1 (PRIOR ART)
FIG. 1 is a side elevational view of a prior art article of footwear.
Figure 2:
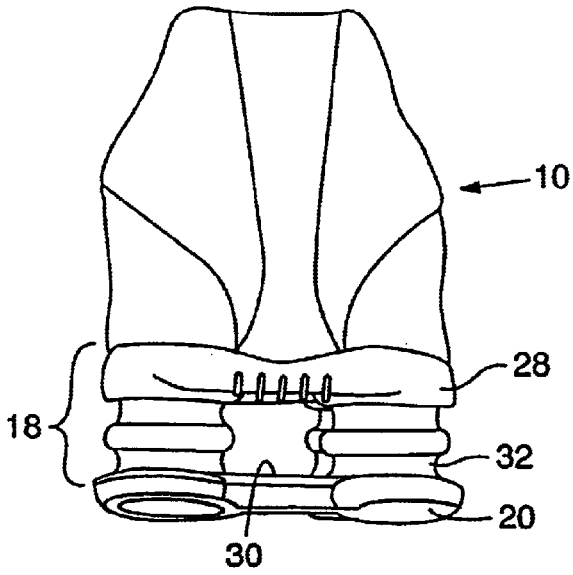
FIG. 2 (PRIOR ART)
FIG. 2 is a rear elevational view of the prior art article of footwear depicted in FIG. 1.
Figure 2A:
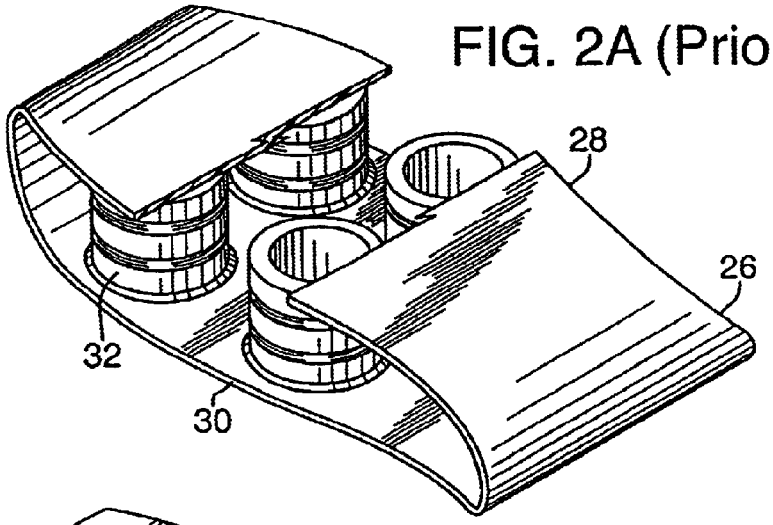
FIG. 2A (Prior Art)
Figure 2B:
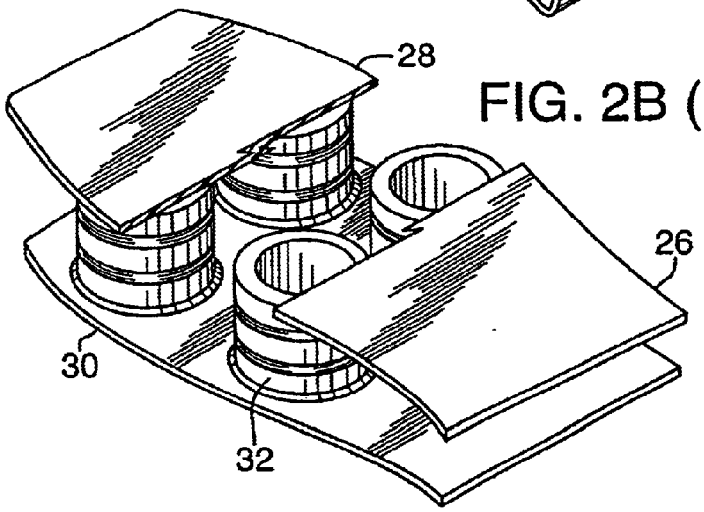
FIG. 2B (Prior Art)
Figure 2C:
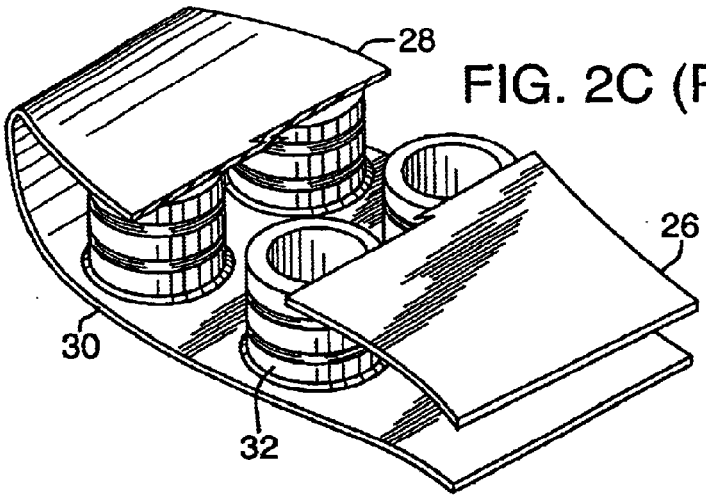
FIG. 2C (Prior Art)

Referring to the drawings, wherein like numerals indicate like elements, an article of footwear that includes a midsole in accordance with the present invention is disclosed. The figures illustrate only the article of footwear intended for use on the right foot of a wearer. One skilled in the art will recognize that a left article of footwear, such article being the mirror image of the right, is included within the scope of the present invention.

Figure 3:
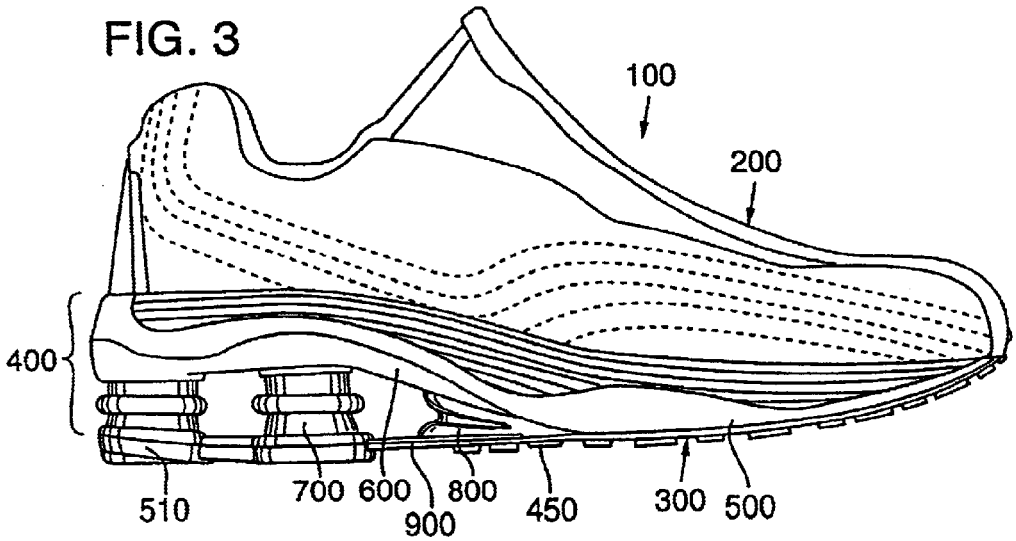
FIG. 3 is a side elevational view of an article of footwear according to the present invention.
Figure 4:
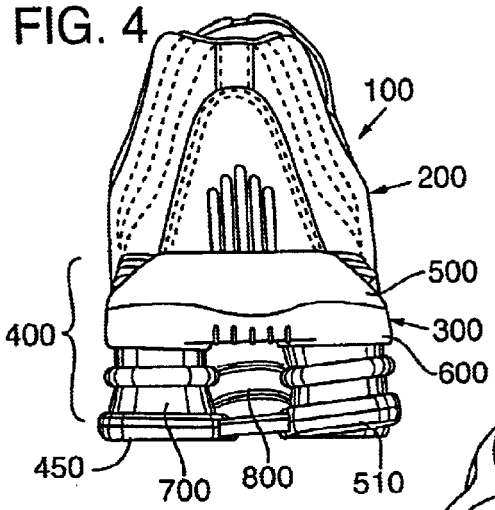
FIG. 4 is a back elevational view of the article of footwear according to the present invention.
Figure 5:
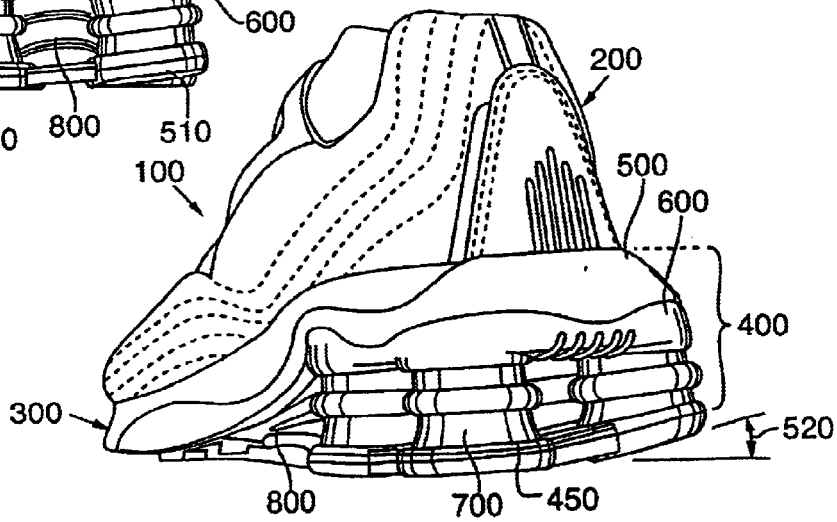
FIG. 5 is a perspective view of the article of footwear according to the present invention.

As depicted in FIGS. 3–5, footwear 100 is an article of athletic footwear, particularly a running shoe. Footwear 100 may, however, be any style of footwear, including a walking shoe, tennis shoe, basketball shoe, hiking boot, or work boot. Footwear 100 includes a conventional upper 200 attached using standard techniques to a sole structure 300. The role of upper 200 is to provide a comfortable and breathable member that secures footwear 100 to a foot of a wearer. Sole structure 300, generally disposed between the foot of the wearer and a playing surface, absorbs impact forces resulting from repetitive contact between footwear 100 and the playing surface. In addition, sole structure 300 controls the motion of the wearer's foot to reduce the probability of an excessive degree of pronatory motion.

Sole structure 300 includes an insole (not shown) located within upper 200, a midsole 400, and an outsole 450. In general, the insole is a thin, shock-absorbing member located directly below the foot of the wearer that enhances the comfort of footwear 100. Midsole 400 is attached to the lower surface of upper 200 and functions as a shock-absorbing and pronation-control component of footwear 100. Outsole 450 is attached to the lower surface of midsole 400 and may be formed of a durable, wear-resistant polymer, such as carbon-black rubber compound. The lower surface of outsole 450 may be textured to provide enhanced traction when contacting a playing surface.

Midsole 400 includes a shock-absorbing layer 500, a heel plate 600, a support component 700, a wedge 800, and a base plate 900. Shock-absorbing layer 500 attaches directly to the lower surface of upper 200 and extends throughout the length of footwear 100. The primary purpose of shock-absorbing layer 500 is to provide a compliant, shock-absorbing medium located in close proximity to the foot of the wearer. Shock-absorbing layer 500 may, therefore, be formed of conventional midsole materials, including foamed polyurethane, phylon, of ethyl vinyl acetate. Peripheral portions of shock-absorbing layer 500 may extend upward to cover lower side portions of upper 200, thereby providing the wearer's foot with lateral support. The thickness of shock-absorbing layer 500 decreases as shock-absorbing layer 500 approaches the heel region of footwear 100. As such, the shock-absorbing properties of shock-absorbing layer 500 are concentrated in the forefoot and midfoot regions of footwear 100. To enhance shock-absorbing properties, a fluid-filled bladder (not shown) may be encapsulated within the forefoot region of shock-absorbing layer 500. As will be described below, support component 700, which includes support elements 701–704, provides shock-absorption to the heel region of footwear 100.

Figure 6A:
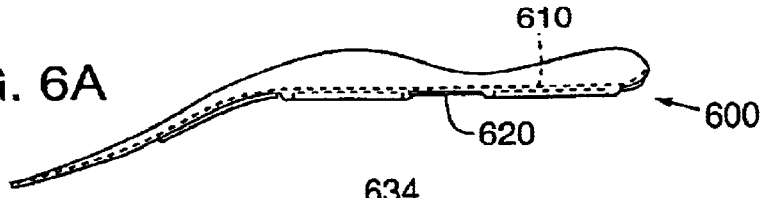
FIG. 6A is a side elevational view of a heel plate according to the present invention.
Figure 6B:
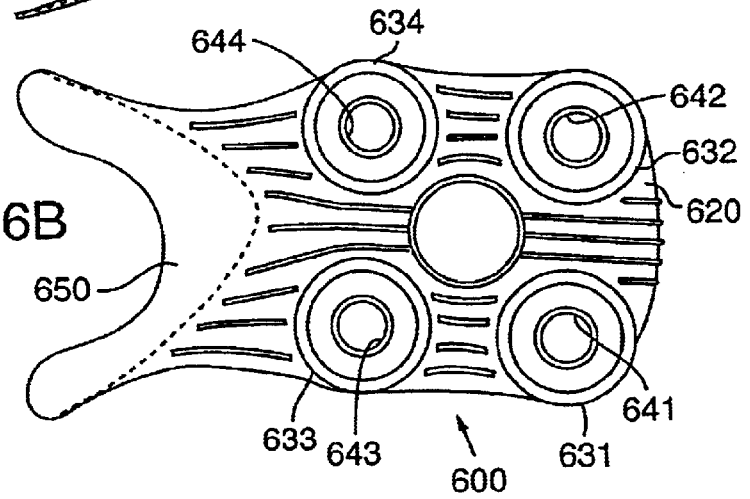
FIG. 6B is a bottom plan view of the heel plate depicted in FIG. 6A.

Heel plate 600, depicted in FIGS. 6A–6B, is disposed between shock-absorbing layer 500 and support component 700. In addition to providing a firm surface that supports the heel region of the wearer's foot, heel plate 600 distributes the shear forces associated with impact among the various support elements 701–704. Accordingly, heel plate 600 may be formed of a lightweight, durable material having a moderate flexural modulus, such as polyester, nylon, or a polyether block copolyamide, and may contain short glass fibers.

The heel region of articles of athletic footwear, including footwear designed specifically for running, is often elevated in relation to the forefoot region. In such articles of footwear, the midfoot region often serves to transition between the higher heel region and lower forefoot region. Heel plate 600 is primarily positioned in the heel region of footwear 100, but extends into the midfoot region. The portion of heel plate 600 positioned in the heel region is generally located above support component 700 and at a higher elevation than the forefoot region of footwear 100. The portion of heel plate 600 positioned in the midfoot region curves downward to form a smooth transition between the elevated heel region and lower forefoot region.

An upper surface 610 of heel plate 600 is attached to the lower portion of shock-absorbing layer 500 using, for example, an adhesive. A lower surface 620 of heel plate 600 includes four sets of concentric raised ridges, comprised of outer ridges 631–634 and inner ridges 641–644, that define sites for receiving support elements 701–704. The use of outer ridges 630 and inner ridges 640, rather than indentations or apertures, limits the formation of protrusions on upper surface 610 that may cause the wearer discomfort. Indentations or apertures may be used, however, if means are provided that ensure comfort. For example, the thickness of shock-absorbing layer 500 may be increased in the heel region or the thickness of heel plate 600 may be increased such that indentations do not create corresponding protrusions. Lower surface 620 of heel plate 600 also includes a smooth wedge attachment area 650 for receiving upper surface 810 of wedge 800, as described below.

Support component 700, depicted in FIGS. 7A–7D, includes four support elements 701–704 connected by a common base 760. Support elements 701–704 are arranged such that first support element 701 is located in the back-lateral corner of the heel region; second support element 702 is located in the back-medial corner of the heel region; third support element 703 is located on the lateral side of the heel region and forward of first support element 701; and fourth support element 704 is located on the medial side of the heel region and forward of second support element 702. Base 760 is formed integral with and extends between support elements 701–704. In the alternative, support elements 701–704 may be formed separately.

Support elements 701–704 may have a variety of configurations. That is, support elements 701–704 may have, for example, a cubic, a conic, a spherical, a pyramidal, or any other regular geometrical shape. In addition to regular shapes, support elements 701–704 may have an irregular geometric shape. Accordingly, support elements 701–704 may have a variety of configurations that perform the functions described herein.

One suitable configuration for support elements 701–704 is a cylindrical shape. Accordingly, each support element 701–704 respectively includes an upper surface 711–714, a lower surface 721–724, an exterior surface 731–734, an interior surface 741–744, and an interior void 751–754.

With reference to support element 702, the above support element attributes will be discussed in greater detail. Support element 702, having a cylindrical configuration, includes an O-shaped upper surface 712. In one embodiment, upper surface 712 is located in the horizontal plane, but may include a downward cant directed toward the interior of the footwear or have other non-planar characteristics.

Exterior surface 732 and interior surface 742, both respectively being the exterior and interior surfaces of the cylindrical configuration of support element 702, define the boundaries of upper surface 712. Exterior surface 732 extends along the outer portion of support element 702 and may include a plurality of physical features, including a smooth surface, circumscribing ridges, one or more circumscribing indentations, one or more circumscribing indentations that include one or more rings, or indicia, as disclosed in U.S. Pat. Nos. 5,353,523 and 5,343,639 to Kilgore et al.

Interior surface 742 is located opposite exterior surface 732 and defines interior void 752. In the embodiment of FIGS. 7A–7D, interior void 752 extends through upper surface 712, but does not extend though lower surface 721. Alternatively, interior void may extend through both upper surface 712 and lower surface 722, through neither upper surface 712 nor lower surface 722, or through only lower surface 722. Lower surface 722 is primarily located in a horizontal plane.

Upper surface 712 is bonded, for example with an adhesive, to lower surface 620 of heel plate 600. As noted above, lower surface 620 includes outer ridges 631–634 and inner ridges 641–644 that define sites for receiving support elements 701–704. With reference to support element 702, outer ridge 632 and inner ridge 642 are positioned on lower surface 620 of heel plate 600 for receiving upper surface 712 therebetween. Accordingly, outer ridge 632 is positioned adjacent to exterior surface 732 and inner ridge 642 is positioned adjacent to interior surface 742. Lower surface 722, which is located in a horizontal plane, is bonded to base plate 900, as will be described below.

Support elements 703 and 704 have characteristics similar to those of support element 702. Support element 701, however, includes a differing configuration on lower surface 721. Whereas support elements, 702–704 have a substantially horizontal lower surface, lower surface 721 of support element 701 includes a downward bevel in a lateral-to-medial and a back-to-front direction, as depicted in FIGS. 7A–7D. A suitable angle by which the bevel departs from a horizontal plane, represented in FIG. 5 as angle 520, is 7.5 degrees, but may range from 5 to 10 degrees. A flange 726 extends around peripheral portions of lower surface 721. More specifically, flange 726 is located adjacent to lower portions of exterior surface 711 in the back, back-lateral, and lateral portions of support element 701. In addition to extending upward so as to cover lower portions of exterior surface 731, flange 726 extends downward below the plane of other portions of lower surface 721. As will be described below, flange 726 overhangs base plate 900 and attaches to outsole 450.

Figure 10:
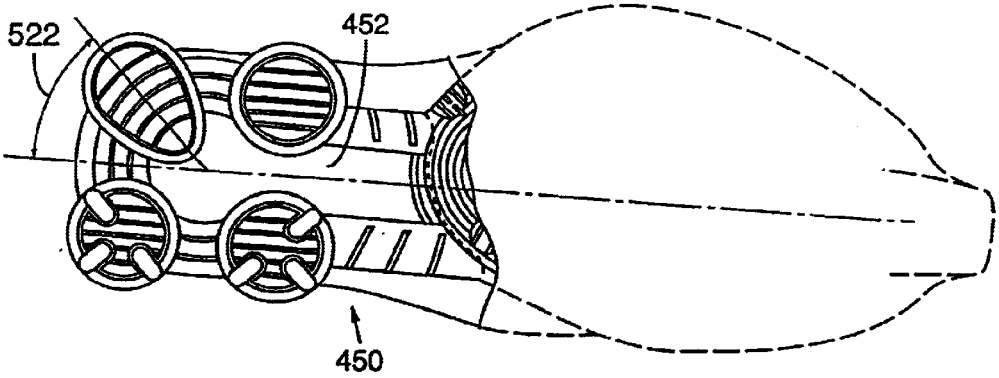
FIG. 10 is a partial bottom plan view of an outsole according to the present invention.

The direction of the downward bevel, as noted above, is in a lateral-to-medial and a back-to-front direction. The angle 522, as depicted in FIG. 10, that a line extending in the direction of the bevel forms when it intersects a longitudinal centerline is 45 degrees, but may be in the range of 30 to 60 degrees.

Suitable materials for support component 700 are rubber, polyurethane foam, or phylon. In addition, a microcellular foam having a specific gravity of 0.5 to 0.7 g/cm$^3$, a hardness of 70 to 76 on the Asker C scale, and a stiffness of 110 to 130 kN/m at 60% compression may be utilized. The material should also return energy in the range of at least 35 to 70% in a drop ball rebound test. Furthermore, the material should have sufficient durability to maintain structural integrity when repeatedly compressed from 50 to 70% of its natural height, for example, in excess of 500,000 cycles. Alternatively, a microcellular elastomeric foam of the type disclosed in U.S. Pat. Nos. 5,353,523 and 5,343,639 to Kilgore et al., which have been incorporated by reference and discussed in the Background of the Invention herein, may be utilized.

Figure 8A:
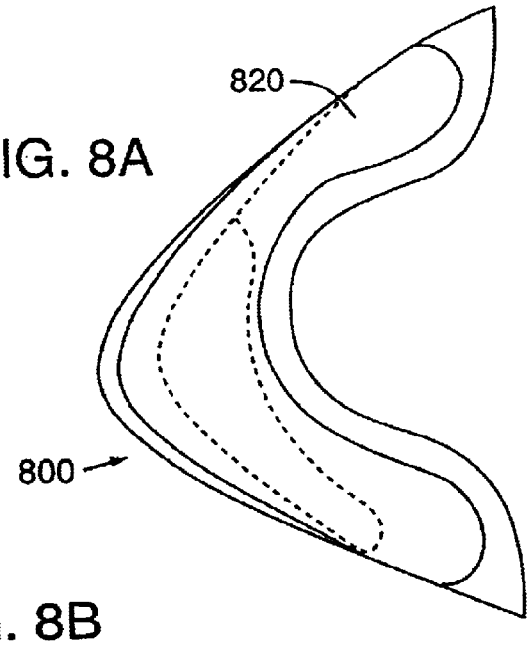
FIG. 8A is a top plan view of a wedge according to the present invention.
Figure 8B:
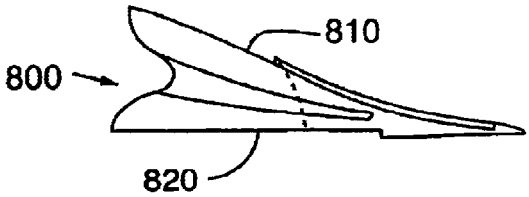
FIG. 8B is a side elevational view of the wedge depicted in FIG. 8A.
Figure 7A:
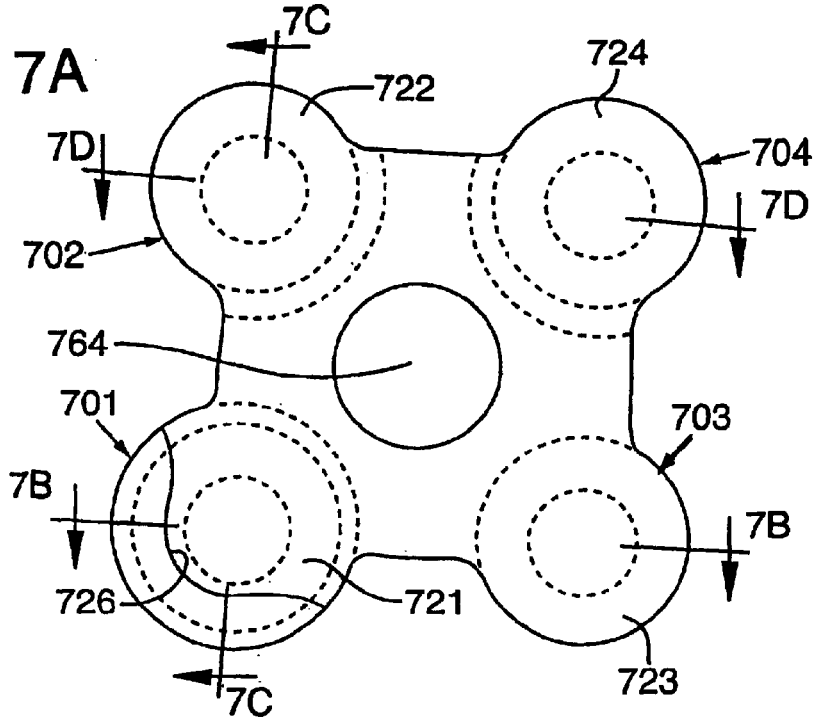
FIG. 7A is a bottom plan view of a support component.
Figure 7B:
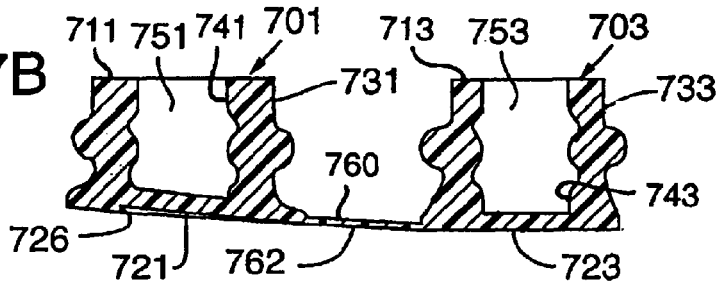
FIG. 7B is a cross-sectional view as defined by section 7B—7B of FIG. 7A.
Figure 7C:
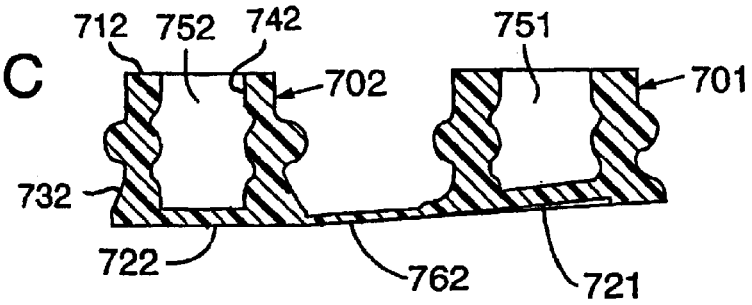
FIG. 7C is a cross-sectional view as defined by section 7C—7C of FIG. 7A.
Figure 7D:
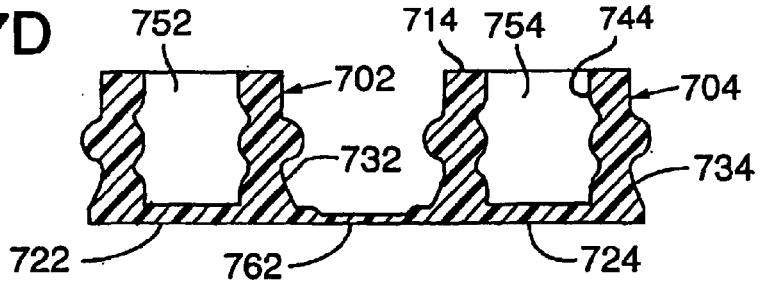
FIG. 7D is a cross-sectional view as defined by section 7D—7D of FIG. 7A.
Figure 7E:
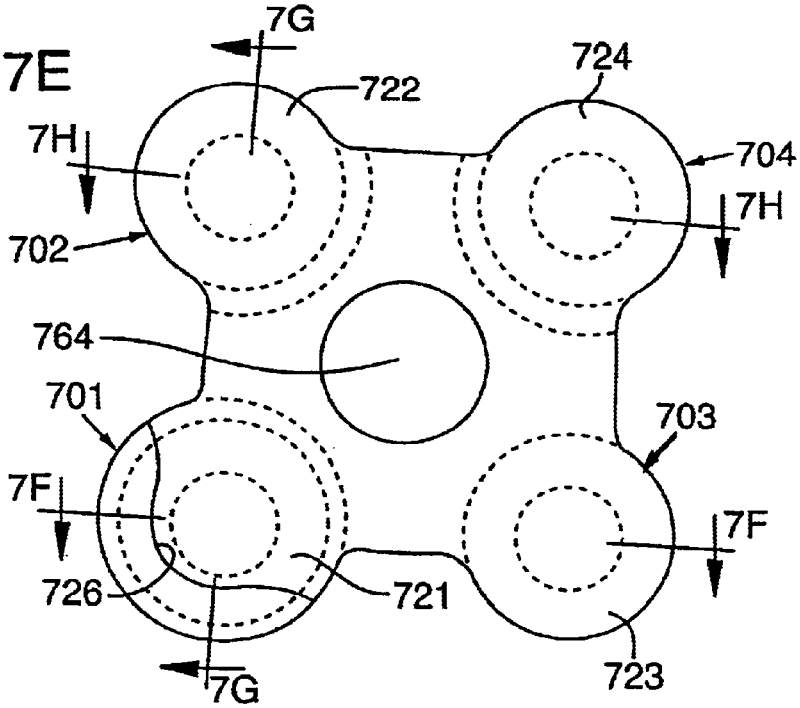
Figure 7F:
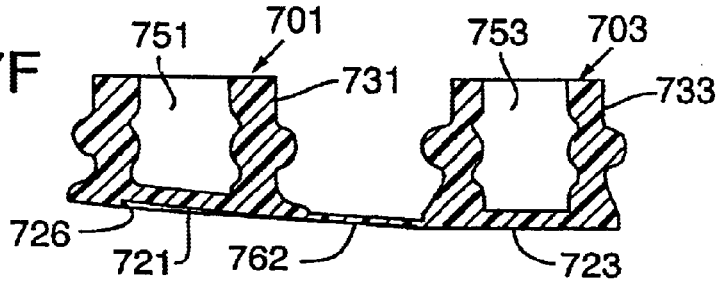
Figure 7G:
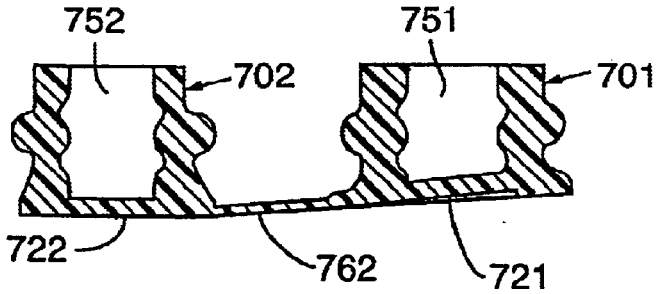
Figure 7H:
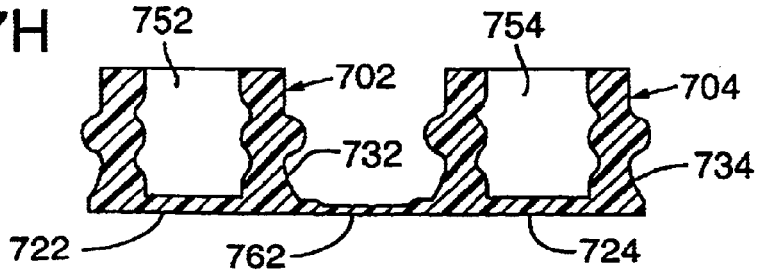

Midsole 400 also includes wedge 800, as depicted in FIGS. 8A–8B, which is located forward of support component 700 and between heel plate 600 and base plate 900. The function of wedge 800 is to absorb impact forces and provide support to the midfoot region of footwear 100, thereby preventing a collapse of heel plate 600. An upper surface 810 of wedge 800 is attached, possibly using an adhesive, to wedge attachment area 650 of heel plate 600. Similarly, a lower surface 820 of wedge 800 is attached to base plate 900. A portion of wedge 800 may overhang base plate 900, thereby attaching to outsole 450. Suitable materials from which wedge 800 may be formed include polyurethane and phylon.

Figure 9B:
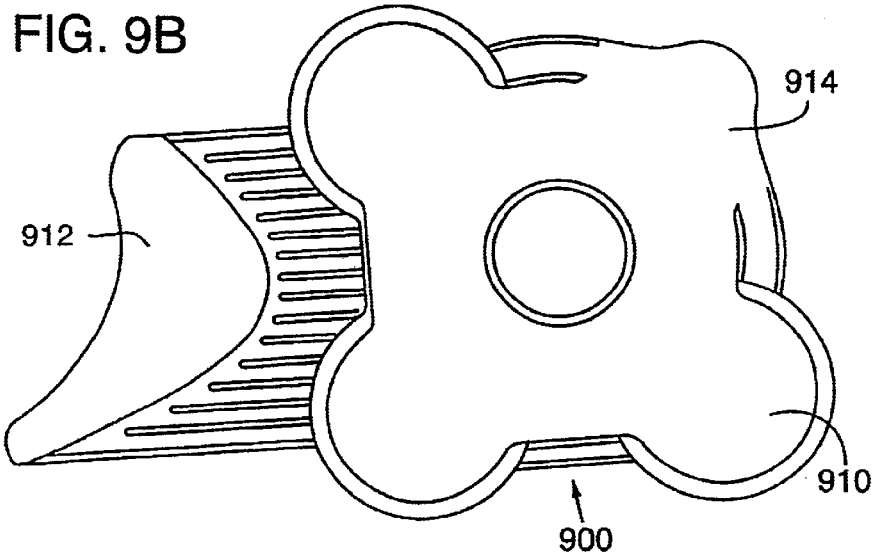
FIG. 9B is a top plan view of the base plate depicted in FIG. 9A.
Figure 9A:
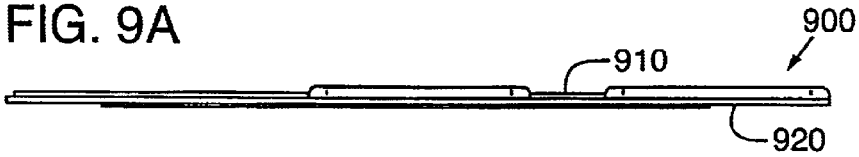
FIG. 9A is a side elevational view of a base plate according to the present invention.

Base plate 900, depicted in FIGS. 9A–9B, is located above outsole 450 and under support component 700 and wedge 800. The purpose of base plate 900 is to distribute the shear forces associated with impact among the various support elements 701–704. Accordingly, base plate 900 may be formed of a lightweight, durable material having a moderate flexural modulus, such as polyester, nylon, or polyether block copolyamide, for example.

Upper surface 910 of base plate 900 includes a smooth wedge attachment area 912 which is generally configured to attach to lower surface 820 of wedge 800. In addition, upper surface 910 includes a support component attachment area 914 for purposes of attaching to support component 700. Support component attachment area 914 is a generally smooth area in an upper surface 910 of base plate 900 that attaches to a lower surface of support component 700, particularly to lower surfaces 721–724 of support elements 701–704 and lower surface 762 of base 760. Peripheral ridge 916 borders the portion of support element attachment area 914 adjacent to support elements 702–704. Accordingly, base plate 900 underlies substantially all of support elements 702–704. Base plate 900, however, underlies only the portion of first support element 701 that does not include flange 726. In other words, flange 726 is configured to overhang and lie adjacent to base plate 900 rather than lie above base plate 900.

Indicia area 930, which may include designs or other indicia, may be centrally located within support component attachment area 914 so as to be visible through aperture 764 of base 760. Indicia area 930 may be located in other portions of base plate 900 or, alternatively, may be absent.

A lower surface 920 of base plate 900 attaches to outsole 450. Outsole 450 may completely cover lower surface 920 or may have an aperture 452 that expose portions of lower surface 920, as depicted in FIG. 10. Accordingly, lower surface 920 may be smooth so as to facilitate attachment of outsole 450 or may include indicia or other designs that are visible through apertures in outsole 450. In addition to attaching to base plate 900, outsole 450 may attach to portions of wedge 800 that overhang base plate 900, forefoot portions of shock-absorbing layer 500, and the portion of lower surface 721 of first support element 701 that overhangs base plate 900, specifically the portion of lower surface 721 that is on flange 726.

The lower surface of outsole 450 is preferably textured to enhance traction and includes an outsole bevel 510 underlying first support element 701 that corresponds with base plate bevel 918. Accordingly, outsole bevel 510 is directed downward in a lateral-to-medial and a back-to-front direction.

The components of footwear 100 described above cooperatively form a footwear system that simultaneously absorbs the shock of impact and reduces the rate at which the foot of the wearer pronates. When footwear 100 initially impacts the playing surface on the back-lateral corner, first support element 701 is subjected to a longitudinal compressive force and a shear force directed orthogonal to the compressive force. Whereas the compressive force acts to longitudinally compress first support element 701, the shear force acts to buckle or otherwise bend first support element 701.

To counter bending, base plate 900 distributes the shear force among the various support elements 701–704, but does not significantly distribute the compressive force. As depicted in FIGS. 9A–9B, the width and length of base plate 900 is significantly greater than the height. Given this configuration, base plate 900 resists bending in the horizontal direction and is semi-rigid in response to forces in the vertical direction. Accordingly, base plate 900 flexes upward to permit a significant portion of the compressive force to act upon support element 701. With regard to the shear force, however, base plate 900 resists horizontal deformation and transfers the shear forces among the four support elements 701 to 704.

As the foot continues to roll from the lateral to the medial side and from the back to the front, a portion of the impact force on support element 701 is transferred to support elements 702 and 703, thereby compressing support elements 702 and 703. Whereas the impact force was initially supported by a single support element, specifically support element 701, the impact force is now supported by support elements 702 and 703, thereby providing increased resistance to compression and reducing the rate of pronation. A similar result occurs as the foot continues to roll and a portion of the compressive force is transferred to support element 704.

The primary purpose of the beveled portion, particularly the downward bevel in first support element 701, is to further reduce the rate of pronation in the wearer's foot. When the beveled portion contacts a playing surface, the curvature of the beveled portion permits the footwear to smoothly transition from the position at heel strike, wherein only the back-lateral corner of the footwear is in contact with the ground, to the position where a substantial portion of outsole 450 is in contact with the ground. That is, the beveled portion permits the footwear to smoothly roll both forward and to the medial side following heel strike. This smooth transition ensures that impact forces are first absorbed by support element 701 and then gradually transferred to support elements 702, 703, and 704, as described above, thereby reducing the rate of pronation.

The present invention is disclosed above and in the accompanying drawings with reference to a variety of preferred embodiments. The purpose served by disclosure of the preferred embodiments, however, is to provide an example of the various aspects embodied in the invention, not to limit the scope of the invention. One skilled in the art will recognize that numerous variations and modifications may be made to the preferred embodiments without departing from the scope of the present invention, as defined by the appended claims.

That which is claimed is:

1. An article of footwear for receiving a foot of a wearer, said article of footwear comprising:

an upper, and a sole structure attached to said upper that includes a midsole and an outsole, said midsole including a compressible first support element located above a portion of said outsole and in a back-lateral corner of said sole structure, a lower surface of said first support element having a downward bevel in a lateral-to-medial and back-to-front direction, and a lower surface of said outsole having a corresponding downward bevel in said lateral-to-medial and back-to-front direction, said downward bevel of said first support element being positioned above said downward bevel of said outsole.

2. The article of footwear of claim 1, wherein said midsole includes a compressible second support element located in a back-medial corner of said sole structure, a compressible third support element located on a lateral side of said sole structure and forward of said first support element, and a compressible fourth support element located on a medial side of said sole structure and forward of said second support element.

3. The article of footwear of claim 2, wherein said support elements are connected by a common base.

4. The article of footwear of claim 2, wherein said downward bevel of said first support element is generally directed toward a center of a calcaneus bone of the wearer.

5. The article of footwear of claim 2, wherein a line extending in the direction of said downward bevel of said first support element forms an intersection with a longitudinal centerline of said footwear, said intersection forming an angle in a range of 30 to 60 degrees.

6. The article of footwear of claim 2, wherein said first support element is formed of a generally cylindrical wall, said wall having an exterior surface and an opposite interior surface, said interior surface defining an interior void that extends through an upper surface of said first support element.

7. The article of footwear of claim 6, wherein said sole structure includes a heel plate and a base plate, said heel plate attaching to said upper surface and said base plate attaching to said lower surface of said first support element.

8. The article of footwear of claim 1, wherein said downward bevel of said of said first support element departs from a horizontal plane to form an angle with said horizontal plane in the range of 5 to 10 degrees.

9. An article of footwear for receiving a foot of a wearer, said article of footwear comprising:

an upper, and a sole structure attached to said upper that includes a midsole and an outsole, said midsole defining a void extending through said sole structure and from a medial side to a lateral side of said sole structure, and said midsole including a compressible first support element with a columnar and vertically-projecting structure, said first support element being located within said void and in a back-lateral corner of said sole structure, said first support element extending between upper and lower portions of the void, a lower surface of said first support element having a downward bevel in a lateral-to-medial and back-to-front direction, and a lower surface of said outsole having a corresponding downward bevel in said lateral-to-medial and back-to-front direction, said downward bevel of said first support element being positioned above said downward bevel of said outsole.

10. The article of footwear of claim 9, wherein said midsole includes a compressible second support element located in a back-medial corner of said sole structure, a compressible third support element located adjacent a lateral side of said sole structure and forward of said first support element, and a compressible fourth support element located adjacent a medial side of said sole structure and forward of said second support element.

11. The article of footwear of claim 10, wherein said second, third, and fourth support elements have a cylindrical configuration.

12. The article of footwear of claim 9, wherein said downward bevel of said first support element departs from a horizontal plane to form an angle with said horizontal plane in the range of 5 to 10 degrees.

13. The article of footwear of claim 9, wherein said downward bevel of said first support element is generally directed toward a center of a calcaneus bone of the wearer.

14. The article of footwear of claim 9, wherein a line extending in the direction of said downward bevel of said first support element forms an intersection with a longitudinal centerline of said footwear, said intersection forming an angle in the range of 30 to 60 degrees.

15. The article of footwear of claim 9, wherein said first support element includes an interior void that extends through an upper surface of said first support element.

16. The article of footwear of claim 15, wherein said sole structure includes a heel plate and a base plate, said heel plate attaching to said upper surface and said base plate attaching to said lower surface of said first support element.

17. An article of footwear for receiving a foot of a wearer, said article of footwear comprising:

an upper, and a sole structure attached to said upper that includes a midsole and an outsole, said midsole defining a void extending through said sole structure and from a medial side to a lateral side of said sole structure, and said midsole including four compressible support elements with a columnar and vertically-projecting structure, each said support element being located within said void and extending between upper and lower portions of the void, a first support element of said support elements being located in a back-lateral corner of said sole structure, a lower surface of said first support element having a downward bevel in a lateral-to-medial and back-to-front direction, and a lower surface of said outsole having a corresponding downward bevel in said lateral-to-medial and back-to-front direction, said downward bevel of said first support element being positioned above said downward bevel of said outsole.

18. The article of footwear of claim 17, wherein said downward bevel of said first support element is generally directed toward a center of a calcaneus bone of the wearer.

19. The article of footwear of claim 17, wherein a line extending in the direction of said downward bevel of said first support element forms an intersection with a longitudinal centerline of said footwear, said intersection forming an angle in the range of 30 to 60 degrees.

20. The article of footwear of claim 17, wherein said downward bevel of said first support element departs from a horizontal plane to form an angle with said horizontal plane in the range of 5 to 10 degrees.

21. The article of footwear of claim 17, wherein said sole structure includes a heel plate and a base plate, said heel plate and said base plate attaching to said support elements.

22. The article of footwear of claim 17, wherein said support elements include an exterior surface and an opposite interior surface, said interior surface defining an interior void that extends through an upper surface of said support elements.

23. An article of footwear having an upper and a sole structure secured to said upper, said sole structure comprising:

a pair of plates that are spaced apart to define a void extending through said sole structure, said void extending from a medial side of said sole structure to a lateral side of said sole structure;

a first support element located within said void and extending between said pair of plates, said first support element being positioned in a back-lateral corner of said sole structure, a lower surface of said first support element having a first downward bevel in a lateral-to-medial and back-to-front direction;

a second support element located within said void and extending between said pair of plates, said second support element being positioned in a back-medial corner of said sole structure;

a third support element located within said void and extending between said pair of plates, said third support element being positioned adjacent said lateral side of said sole structure and forward of said first support element;

a fourth support element located within said void and extending between said pair of plates, said fourth support element being positioned adjacent said medial side of said sole structure and forward of said second support element;

an outsole that forms a ground-contacting surface of said article of footwear, said outsole extending under said first support element and having a second downward bevel in said lateral-to-medial and back-to-front direction, said second downward bevel being positioned below said first downward bevel.

* * * * *